US006167768B1

(12) United States Patent
Bechler et al.

(10) Patent No.: US 6,167,768 B1
(45) Date of Patent: Jan. 2, 2001

(54) LIFTING APPARATUS

(75) Inventors: Russell Alan Bechler, Bellbrook; Edward James Limbert, Monroe, both of OH (US)

(73) Assignee: Heidelberger Druckmaschinen AG (DE)

( * ) Notice: Under 35 U.S.C. 154(b), the term of this patent shall be extended for 0 days.

(21) Appl. No.: 09/196,173

(22) Filed: Nov. 20, 1998

(51) Int. Cl.[7] ..... F16H 25/16; F16H 35/08
(52) U.S. Cl. ..... 74/53; 74/828; 74/838
(58) Field of Search ..... 74/53, 828, 831, 74/838

(56) References Cited

U.S. PATENT DOCUMENTS 490,308 * 1/1893 Pitceathly ..... 74/838 X
4,235,130 * 11/1980 Dulgar et al. ..... 74/831

* cited by examiner

*Primary Examiner*—Allan D. Herrmann
(74) *Attorney, Agent, or Firm*—Burns, Doane, Swecker & Mathis L.L.P.

(57) ABSTRACT

An apparatus for lifting a pile of flat products especially a pile of sheets or signatures has a lift lever and a cam follower arm with a first and second end. The cam follower arm is coupled to said lift lever. A cam follower is connected to said cam follower arm and a drive link is coupled to one of said ends of said cam follower arm. A drive link roller is connected to said drive link and a guide ramp is arranged for guiding said drive link roller.

10 Claims, 4 Drawing Sheets

LIFTING APPARATUS

TECHNICAL FIELD

This invention relates to an apparatus for lifting a pile of flat products, especially a pile of sheets or signatures.

BACKGROUND OF THE INVENTION

In the technology of building books including booklets, magazines, newspapers, periodicals, and so on, he use of collating systems is well known. These systems typically have a transporting device on which individual flat products such as signatures or sheets are gathered to build a book-block set, which then is finished and bound. The transporting devices may be of any kind, such as flat-backs, saddle conveyors or pocket feeders. Pocket feeders typically comprise a plurality of pockets in which the book block is build up or to which additional sheets or signatures, so-called inserts may be added typically a number of hoppers is arranged along the transporting device where each of the hoppers comprises a feeding mechanism for feeding an individual flat product from a pile of signatures onto the transporting device, in order to progressively build up the book-block set or to insert a supplement sheet into a pocket of a pocket feeder or into a newspaper arranged in the pocket. As the individual sheets or signatures are fed from the bottom of the pile it is necessary to provide an apparatus to maintain the lowermost flat product in the pile where this apparatus is able to lift the pile during the feeding operation.

A lifting apparatus of this kind is already known in the art and described in connection with FIG. 4. The lifting apparatus 10 according to the prior art can be spilt into three sections: a pivoting shaft 12, an adjustment link 14 and a pile lifting finger 16 movable along a roller 16', and having an arm 19' with a slot that cooperates with a roller attached with an arm 19". The adjustment link 14 is clamped to the pivoting shaft 12 as well as a cam follower arm (not shown). The can follower arm is connected to a cam on a main hopper drive shaft and actuates the cam follower arm. When the arm pivots it rotates the pivoting shaft 12 and the adjustment link 14 respectively. A roller 18 which is mounted on the adjustment link 14 pushes up and guides down the lifting finger 16. The pile lifting finger 16 therefore is movable along a path indicated by the arrow between positions "A" and "B". The lifting height of the pile lifting finger 16 can be adjusted by rotating the knob 15 which in turn rotates the adjustment screw 19. A locking knob 17 is used to fix this position.

It is obvious that the present design does not allow to adjust the height during operation as the adjustment mechanism itself moves up and down during operation. Furthermore, it is also necessary to provide a separate guard around the adjustment as the adjustment moves during operation.

SUMMARY OF THE INVENTION

It is therefore an object of the present invention to overcome the shortcomings of the prior art and to provide a lifting apparatus for lifting a pile of flat products, especially a pile of sheets or signatures in a hopper unit, where the adjustment mechanism does not move together with a movement of the pile lifting finger.

It is a further object of the present invention to provide a lifting apparatus where the amount of lift can be adjusted to higher and lower position during the operation of the lifting finger ("on the fly"), preferably without the use of any tools.

Now, in order to implement these and still further objects of the invention which will become more apparent as the description proceeds, the apparatus of the present development is manifested by the features that it includes a lift lever, a cam follower arm having a first and second end and being coupled to said lift lever at its first end. Furthermore, a cam follower is connected to the cam follower arm and a drive link is coupled to the second end of the cam follower arm. A drive link roller is connected to the drive link and a guide ramp is provided for guiding said drive lint roller.

By virtue of this arrangement significantly low mass has to be moved during operation of the apparatus. Furthermore, it is possible to adjust the amount of lift without defecting the downward position which results in less impact of the systems components against other hopper components. This again results in less noise and less wear.

BRIEF DESCRIPTION OF THE DRAWINGS

These other objects, advantages and features of the invention will become more apparent from the following description taken in conjunction with the accompany drawings, wherein.

DETAILED DESCRIPTION OF THE PREFERRED EMBODIMENT

Figure 1:
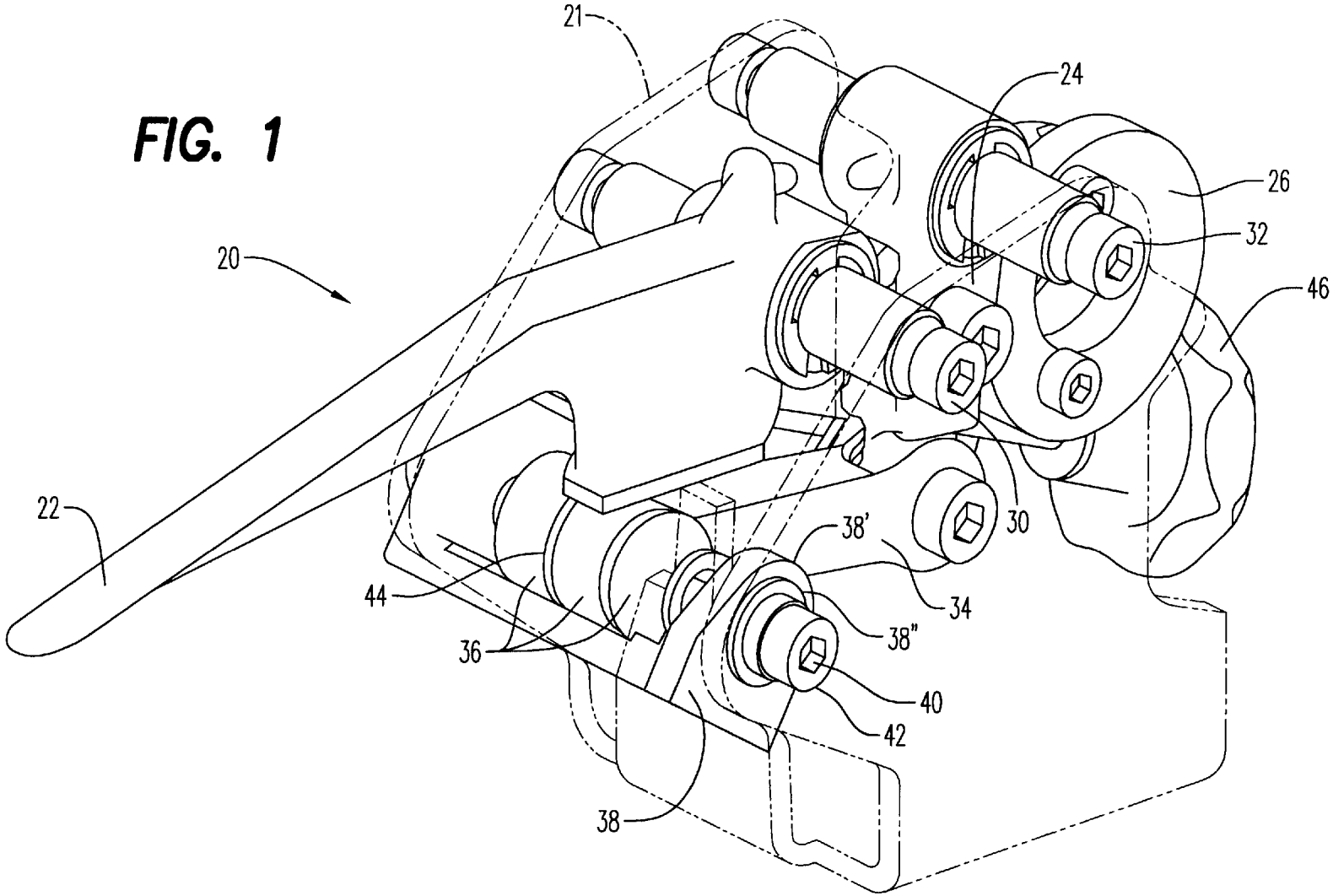
FIG. 1 is a perspective view of pile lift according to the present invention.

Referring now to FIG. 1 a perspective view of the lifting apparatus according to the present invention is shown. The lifting apparatus 20 which may be arranged in a housing 21, includes a lift lever 22 which is rotatably mounted on an axis 30. A cam 26 operates on a can follower 28 (FIGS. 2 and 3) which is mounted on a cam follower arm 24. A first end of the cam follower arm is connected to an axis 32 and a second end of the cam follower arm is coupled to the first end of a drive link 34, At the second end of the drive link 34 at least one drive link roller 36 is mounted. Preferably, there are three drive link rollers 36, where one of them is arranged between the two others and the two outer rollers ride upon a guide ramp 38. The guide ramp is rotatably mounted on the housing 21 and may rotate about pivoting point 40 which may be represented by a rivet pin or a screw 42.

As the guide ramp 38 is rotatable about pivot point 40. The angular position of the guide ramp 38 may be adjusted to a required value.

Figure 2:
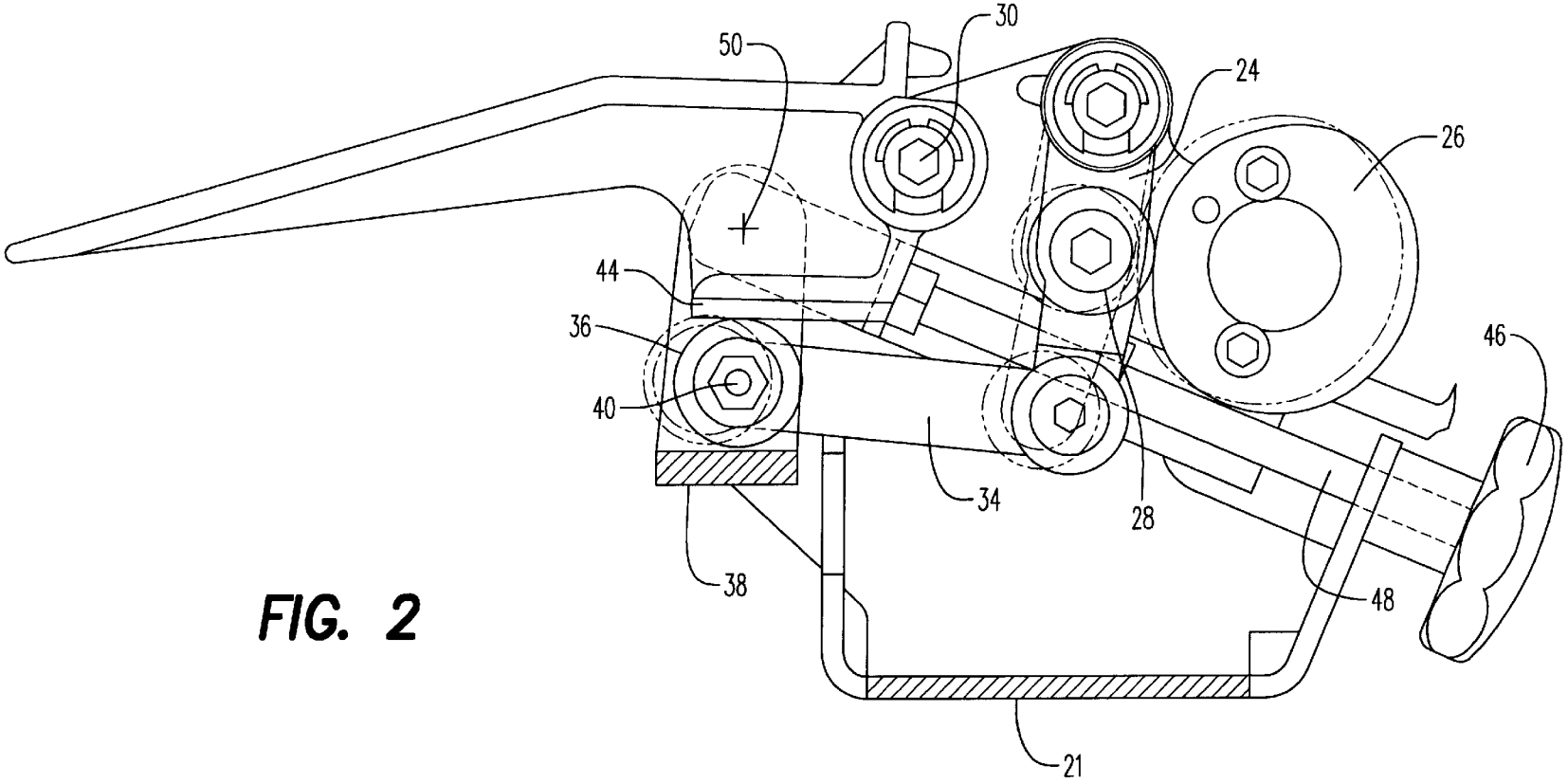
FIG. 2 is a schematic side view of the pile lift in a no-lift position.

Referring now to FIG. 2 which shows a schematic side view of the lifting apparatus according to the present invention the guide ramp 38 has been set to a zero angle position which results in a so-called "no lift operation" during the feeding operation of the hopper. As the lifting apparatus is a cam driven device the cam follower arm 24 has a cam follower 28 which is In contact to a cam 26. The cam follower arm 24 is coupled to the lift lever 22 at a first end of the lift lever 22. The cam has an irregularly shaped surface resulting in a plurality of cam portions. Preferably, the cam has four portions, a low dwell, a rise, a high dwell and a fall. During the low dwell the system is at an initial rest position. Upon the rotation of the cam 26 the cam follower 28 follows the irregularly shaped surface of the cam 26 and the cam follower arm 24 is rotated about the axis 32. When the cam follower arm 24 rotates it moves the drive link 34 and the drive link rollers 36 which are arranged at the end of the drive link 34 move along the guide ramp 38. Depending on the angular position of the guide ramp the lifting lever will only move a certain amount when the guide ramp is different from a so-called "zero position" where the surface of the guide ramp 38 is parallel to the riding surface 44 of the lift lever 22. In this zero position, which is shown in FIG. 2, the lifting lever will not rise because the roller 36 does not push up the riding surface 44.

Figure 3:
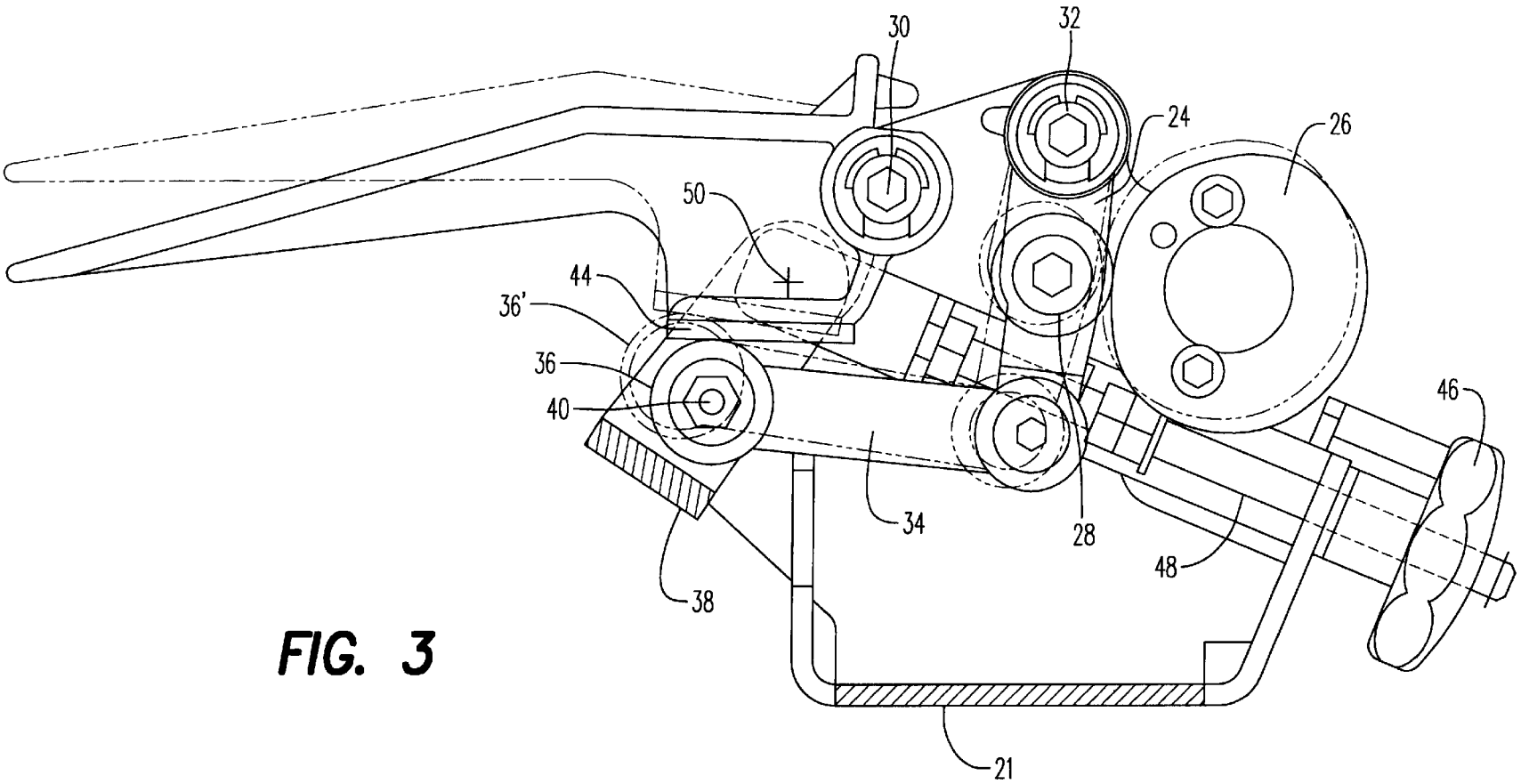
FIG. 3 is a schematic side view of the pile lift in a lift position.
Figure 4:
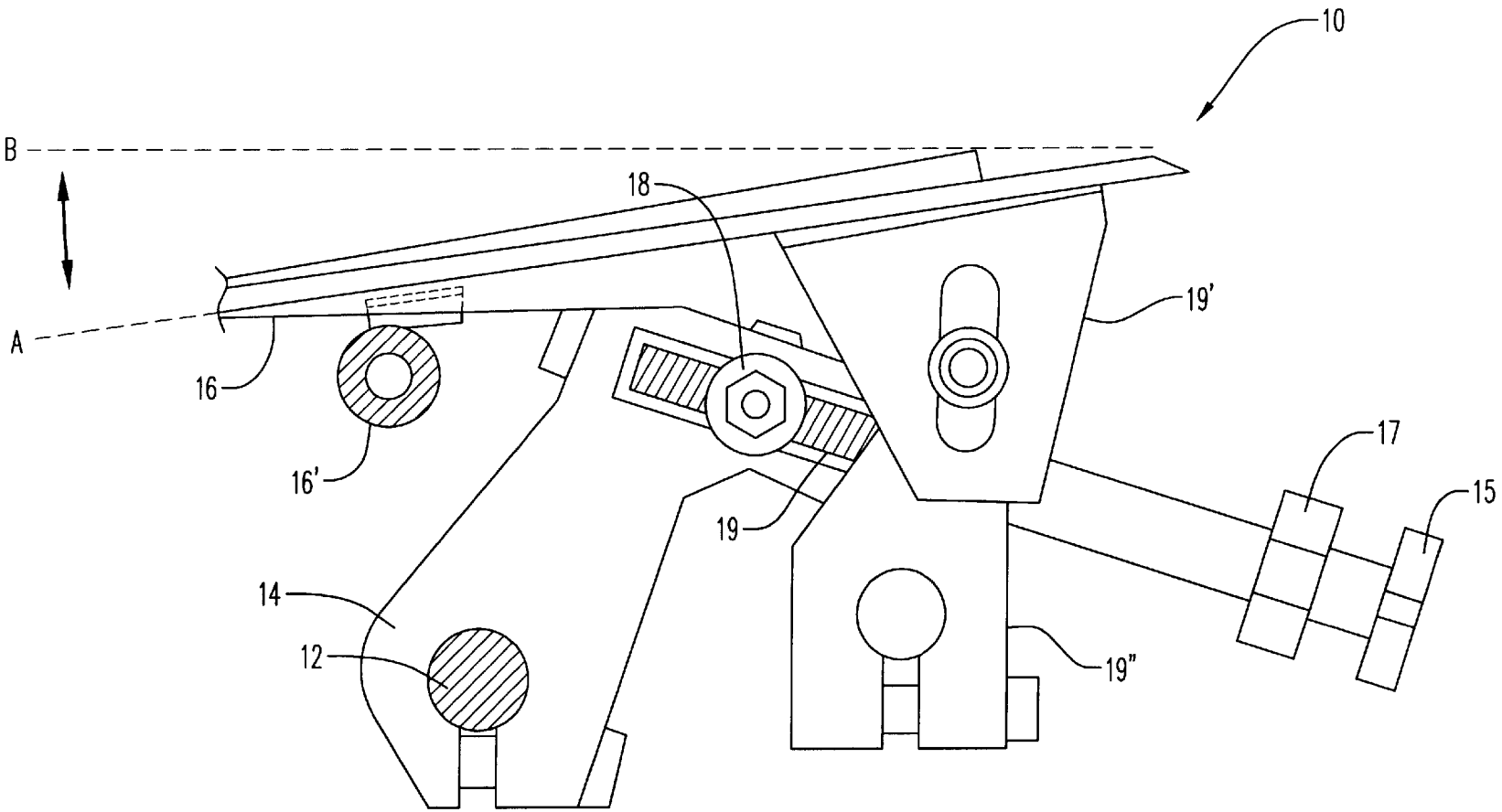
FIG. 4 (PRIOR ART)
FIG. 4 is a schematic side view of a pile lift according to prior art.

However, it is possible to change the angular position of the guide ramp 38 as the guide ramp is rotatably mounted about a pivot point 40. This is preferably achieved by connecting the guide ramp to a pair of bushings 38', each having a recess 38" for fixing the guide ramp to the bushings and the housing 21 by a screw 42 or a rivet pin. To adjust the angular position of the guide ramp 38 an adjusting unit may be provided for adjusting the amount of rotation of said guide ramp 38 which is shown in FIG. 3. This adjustment unit includes an adjustment knob 46, an adjustment rod 48 and a link joint 50 to which the guiding ramp 38 is coupled. By turning the knob 46 which in turn pulls the rod 48 a pivoting of the guide ramp 38 is caused around pivot point 40. In this way the guide ramp can be adjusted to substantially any desired angular position. When the guide ramp 38 is adjusted to an angular position different from the zero position the space between the guiding ramp 38 and the riding surface 44 is decreased so that whenever the rollers 36 move forward to a position 36' indicated by the dotted lines the lift lever 22 moves from his lower position A to his upper position B without moving the adjustment unit.

Preferably, the pivot point 40 of the ramp 38 coincides with the center of the roller 36 in the back position of the roller, which is also the no lift position of the lift lever 22. Any change in the angular position of the guide ramp 38 therefore requires that the guide ramp 38 is rotated about the center of the roller 36. This results in no change of the downward position of the lift lever.

The degree of rotation of the guide ramp 38 determines the amount of lifting of the lift lever 22 depending on the movement of the drive link 34 and the drive link roller 36 respectively.

As already indicated in FIG. 1 the drive link 34 is preferably connected to a plurality of drive link rollers 36, for example to three drive link rollers, where all the drive link rollers are arranged co-axial. As these drive link rollers are arranged side by side the outer two rollers ride upon the guide ramp which has previously been pivoted to the desired angular position onto bushings situated in the housing 21 of the lifting apparatus 20. The middle roller pushes the lift lever 22 with respect to the angle of the guide ramp by pushing the riding surface 44.

The lifting apparatus 20 described above allows adjustment without using any additional tools which decreases the amount of setup time. The angular position of the ramp and the amount of lifting of the lift lever 22 respectively can be adjusted during operation of the lifting apparatus as the adjusting unit does not move during operation. Furthermore, the ability to adjust the amount of lift without defecting the downward position results in a less impact of the system components against other hopper components.

It will of course be understood that the present invention has been described above purely by way of example and that modifications of detail can be made within the scope of the invention Without further analysis the foregoing will so fully reveal the gist of the present invention that others can by applying current knowledge readily adapted for various applications without omitting features that, from the standpoint of prior art, fairly constitute essential characteristics of the generic or specific aspects of this invention and, therefore such adaptations should and are intended to be comprehended within to be comprehend within the meaning and range of equivalence of the following claims.

| PART LIST | |
|---|---|
| 10 | lifting apparatus (prior art) |
| 12 | pivoting shaft |
| 14 | adjustment link |
| 15 | adjustment knob |
| 16 | pile lifting finger |
| 17 | locking knob |
| 18 | roller |
| 19 | adjustment screw |
| 20 | lifting apparatus |
| 21 | housing |
| 22 | lift lever |
| 24 | cam follower arm |
| 26 | cam |
| 28 | cam follower |
| 30 | axis |
| 32 | axis |
| 34 | drive link |
| 36 | drive link roller |
| 38 | guide ramp |
| 40 | pivot point |
| 42 | screw |
| 44 | riding surface |
| 46 | adjustment knob |
| 48 | adjustment rod |

What is claimed is:

1. An apparatus for lifting a pile of flat products comprising:

a lift lever having a first end;

a cam follower arm having a first end and a second end, and being coupled to said lift lever at said first end of said lift lever;

a cam follower connected to said cam follower arm;

a drive link coupled to said second end of said cam follower arm;

a drive link roller connected to said drive link; and a guide ramp for guiding said drive link roller.

2. An apparatus according to claim 1 wherein said guide ramp is rotatable about a pivot point.

3. An apparatus according to claim 2, wherein said guide ramp is connected to a pair of bushings, each having a recess defining said pivot point.

4. An apparatus according to claim 3, wherein said guide ramp is coupled to an adjusting unit for adjusting the amount of rotation of said guide ramp.

5. An apparatus according to claim 4, wherein said adjusting unit comprises:

means for rotating said guide ramp; and means for fixing said guide ramp in a predetermined position of rotation.

6. An apparatus according to claim 5, wherein said means for rotating said guide ramp includes:

a movable rod coupled to said guide ramp.

7. An apparatus according to claim 6, said means for rotating said guide ramp further comprising:

a knob for moving said rod and for fixing said rod in a predetermined position.

8. A method for adjusting the amount of lift of a lift lever of an apparatus for lifting a pile of flat products, the method comprising the steps of:

pivoting a guide ramp, which guides a drive link roller of a drive link coupled to said lift lever via a cam follower arm, to a predetermined position; and fixing said guide ramp in said predetermined position.

9. A method according to claim 8 wherein the apparatus comprises a rod coupled to said guide ramp and a knob connected to said rod, said method including the steps of:

pivoting said guide ramp in said predetermined position by turning said knob which in turn pulls said rod.

10. A method for lifting a lift lever of an apparatus which includes a riding surface of said lift lever, said method comprising the steps of:

pivoting a guide ramp, which guides a drive link roller of a drive link coupled to said lift lever via a cam follower arm, to an angular position different than an angular position of said riding surface; and moving said drive link roller along said guide ramp.

* * * * *